US007223133B2

(12) United States Patent
Conn et al.

(10) Patent No.: US 7,223,133 B2
(45) Date of Patent: May 29, 2007

(54) ELECTRICAL CONDUCTOR WEDGE CONNECTOR SPLICE

(75) Inventors: Gary A. Conn, Mobile, AL (US); Jennifer M. Peterson, Epping, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/026,911

(22) Filed: Dec. 30, 2004

(65) Prior Publication Data

US 2006/0148334 A1 Jul. 6, 2006

(51) Int. Cl.
*H01R 11/01* (2006.01)

(52) U.S. Cl. ..... 439/783

(58) Field of Classification Search ..... 439/783, 439/784, 796, 863

See application file for complete search history.

(56) References Cited

U.S. PATENT DOCUMENTS

| | | | | |
|---|---|---|---|---|
| 399,465 | A | 3/1889 | Bainbridge | |
| 3,290,746 | A | 12/1966 | Broske | 24/126 |
| 3,588,791 | A | 6/1971 | Polidori | 339/247 |
| 4,451,104 | A | 5/1984 | Hodgson et al. | 339/99 R |
| 4,508,409 | A | 4/1985 | Cherry et al. | 339/97 R |
| 4,629,274 | A | 12/1986 | Pollock | 339/95 R |
| 4,634,205 | A | 1/1987 | Gemra | 339/97 P |
| 4,722,189 | A | 2/1988 | Center | 60/635 |
| 4,857,020 | A * | 8/1989 | Crosby | 439/783 |
| 5,683,273 | A | 11/1997 | Garver et al. | 439/784 |
| 5,862,589 | A | 1/1999 | Chadbourne et al. | 29/882 |
| 5,868,588 | A | 2/1999 | Chadbourne et al. | 439/783 |
| 5,916,001 | A | 6/1999 | Chadbourne | 439/783 |
| 5,944,564 | A | 8/1999 | Chadbourne et al. | 439/783 |
| 5,944,565 | A | 8/1999 | Chadbourne et al. | 439/783 |
| 6,193,565 | B1 | 2/2001 | Herron | 439/783 |
| 6,599,054 | B2 | 7/2003 | Ouimet | 403/374.1 |
| 2002/0119710 | A1* | 8/2002 | Mello et al. | 439/783 |
| 2002/0142674 | A1 | 10/2002 | Chadbourne et al. | 439/783 |
| 2006/0148333 | A1* | 7/2006 | Peterson | 439/783 |

* cited by examiner

*Primary Examiner*—Tho D. Ta
*Assistant Examiner*—Vanessa Girardi
(74) *Attorney, Agent, or Firm*—Harrington & Smith, PC

(57) ABSTRACT

An electrical conductor splice for connecting at least two electrical conductors. The splice includes a connector shell having a generally elongate open first lateral side; and two wedges adapted to be located in the shell at longitudinally spaced positions from each other inside opposite ends of the shell. Each wedge has a first side with a conductor contact surface and an opposite second side with a shell contact surface. The shell includes a conductor contact section for contacting the conductors. The conductor contact section is adapted to receive two of the conductors into the shell from opposite directions in generally coaxially aligned positions.

35 Claims, 8 Drawing Sheets

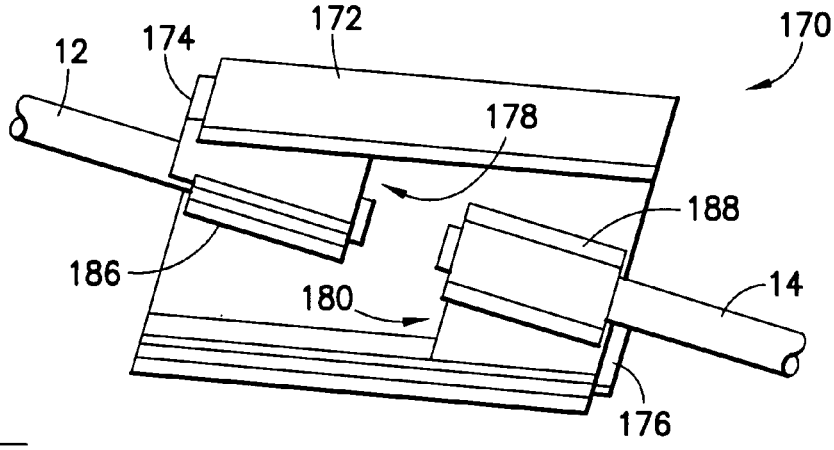
FIG.22
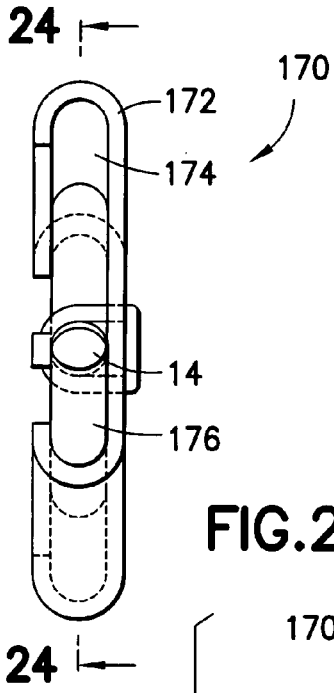
FIG.23
FIG.24
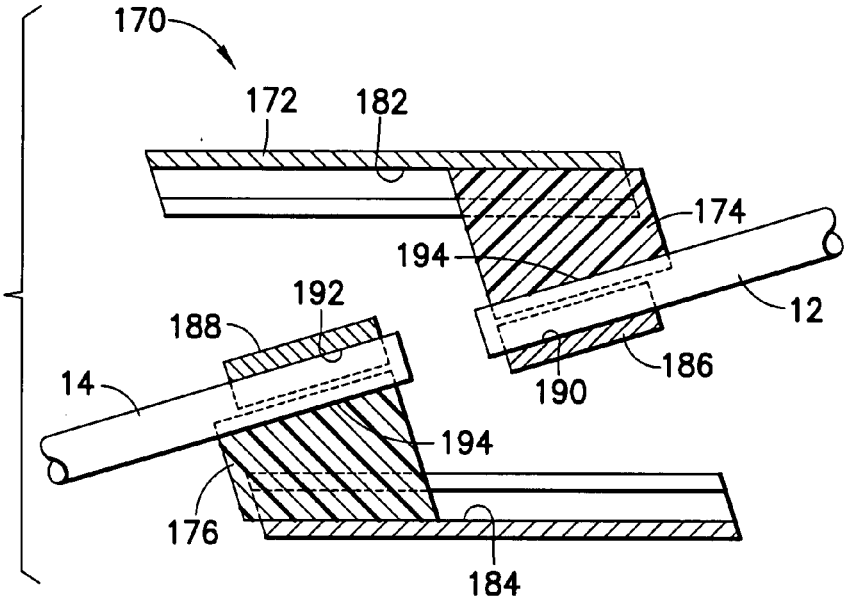

ELECTRICAL CONDUCTOR WEDGE CONNECTOR SPLICE

BACKGROUND OF THE INVENTION

1. Field of the Invention

The present invention relates to electrical connectors and, more particularly, to a splice for connecting electrical conductors.

2. Brief Description of Prior Developments

U.S. Pat. No. 6,193,565 discloses a splicing connector having a connector shell with a general H shaped cross section. The splicing connector includes two wedge assemblies that are inserted into the H shaped connector shell for attaching two electrical conductors to each other. Electrical wedge connectors are also well known in the art, such as disclosed in U.S. Pat. No. 5,868,588 which include a tapering cross sectional C shape shell and a wedge. A powder actuated tool, such as a Wejtap™ tool sold by FCI USA, Inc., is used to propel the wedge into the shell to fixedly attach to conductors to each other.

In the early 1990's, an automatic splice was introduced to the electric utility market in the United States. Although initially promoted as a convenient, temporary connection to speed outage restoration, it's easy, tool-free installation quickly made it a favorite among linemen. In rather short order, automatic splices were soon being employed as permanent installations in almost every utility in the United States. However, 10 years later, automatic splices are failing at an alarming rate and most major utilities are desperately seeking a reliable, cost-efficient replacement. However, despite these failures, most utilities remain unwilling to mandate a return to the time tested (but labor-intensive) process of installing compression high-tension sleeves. As such, an incredibly large and enormously profitable, untapped market awaits the first manufacturer to produce a high-tension splice that provides reliability and ease of installation at an affordable price.

SUMMARY OF THE INVENTION

In accordance with one aspect of the present invention, an electrical conductor splice is provided for connecting at least two electrical conductors. The splice includes a connector shell having a generally elongate open first lateral side; and two wedges adapted to be located in the shell at longitudinally spaced positions from each other inside opposite ends of the shell. Each wedge has a first side with a conductor contact surface and an opposite second side with a shell contact surface. The shell includes a conductor contact section for contacting the conductors. The conductor contact section is adapted to receive two of the conductors into the shell from opposite directions in generally coaxially aligned positions.

In accordance with another aspect of the present invention, an electrical conductor splice connector shell is provided comprising a first wedge receiving end section having a general wedge shaped profile; and a second wedge receiving end section having a general wedge shaped profile. The first and second end sections are located at opposite longitudinal ends of the shell and have their wedge shaped profiles orientated in general reverse directions.

In accordance with another aspect of the present invention, an electrical wedge connector splice wedge is provided comprising a first end section having a general wedge shaped profile with a first conductor contact surface on a first side of the wedge; and a second end section having a general wedge shaped profile with a second conductor contact surface on the first side of the wedge. The first and second end sections are located at opposite longitudinal ends of the wedge. Their wedge shaped profiles are orientated in general reverse directions.

In accordance with another aspect of the present invention, an electrical wedge connector splice wedge is provided comprising a first member having a first side and a second opposite side, the first side comprising a first electrical wedge connector splice shell contact surface, the second opposite side comprising a slot extending into the second opposite side, the slot having a first conductor contact surface therein; and a second member movably connected to the first member. The second member extends into the slot. The second member comprises a first side and an opposite second side. The first side of the second member comprising a second electrical wedge connector splice shell contact surface located in the slot. The second opposite side of the second member comprising a second conductor contact surface. The first and second conductor contact surfaces are located opposing each other.

In accordance with one method of the present invention, a method of connecting two electrical conductors s provided comprising steps of attaching a first electrical wedge connector splice wedge to a first conductor; attaching a second electrical wedge connector splice wedge to a second conductor; inserting the first and second splice wedges into an electrical wedge connector splice shell; and moving the first and second splice wedges in opposite directions, the step of moving comprising a powder actuated tool being fired to wedge the splice wedges into fixed stationary positions at respective opposite ends of the splice shell.

In accordance with another method of the present invention, a method of connecting the two electrical conductors is provided comprising steps of attaching an electrical wedge connector splice wedge to the two conductors, the conductors extending out of opposite respective ends of the splice wedge; connecting two electrical wedge connector shells to opposite respective ends of the splice wedge; and moving the two shells relative with the wedge to wedge the opposite respective ends of the wedge in respective ones of the shells.

In accordance with another aspect of the present invention, an electrical conductor splice for connecting at least two electrical conductors is provided comprising a connector shell; and two wedges adapted to be located in the shell at opposite ends of the shell. Each wedge has a first side with a conductor contact surface and an opposite second side with a shell contact surface. The shell comprises at least one conductor contact section for contacting the conductors. The at least one conductor contact section is adapted to receive two of the conductors in a generally aligned position at the respective opposite ends of the shell.

BRIEF DESCRIPTION OF THE DRAWINGS

The foregoing aspects and other features of the present invention are explained in the following description, taken in connection with the accompanying drawings, wherein:

FIG. 22 is a side view of another alternate embodiment of the present invention;

FIG. 23 is an end view of the splice connector shown in FIG. 22; and

FIG. 24 is a cross sectional view of the splice connector shown in FIG. 23 taken along line 24—24.

DETAILED DESCRIPTION OF THE PREFERRED EMBODIMENTS

Figure 1:
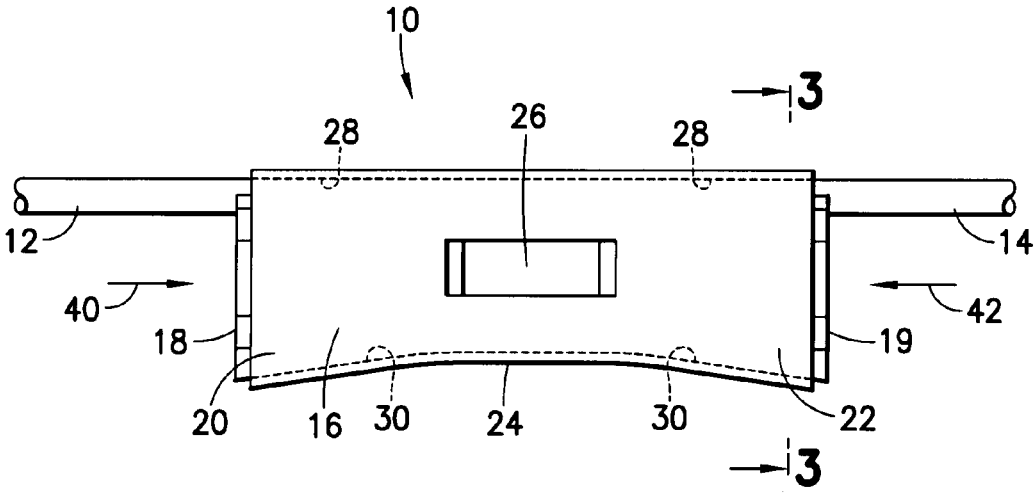
FIG. 1 is a side view of a splice connector incorporating features of the present invention.

Referring to FIG. 1, there is shown a side view of an electrical conductor splice 10 incorporating features of the present invention; shown connecting two conductors 12, 14 to each other. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
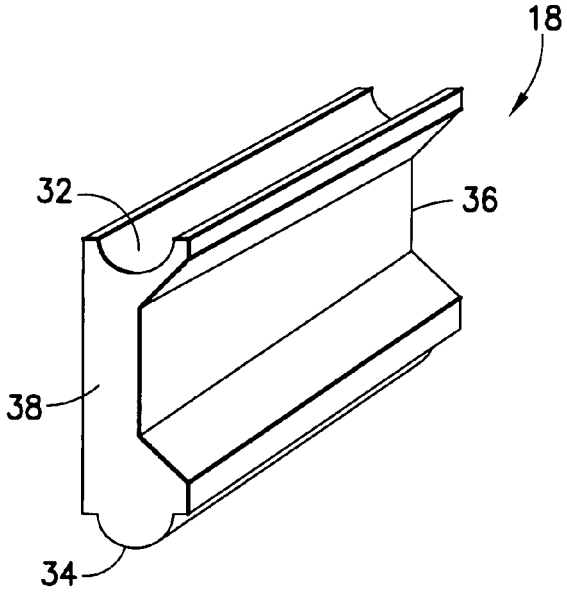
FIG. 2 is a perspective view of one of the wedges used in the splice connector shown in FIG. 2.
Figure 3:
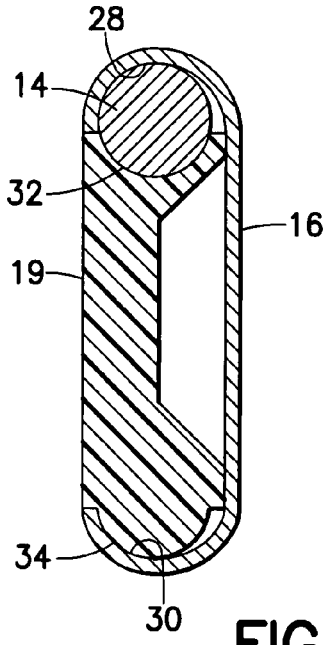
FIG. 3 is a cross sectional view of the splice connector shown in FIG. 1 taken along line 3—3.

Referring also to FIGS. 2 and 3, the spice connector 10 generally comprises a connector shell 16 and two wedges 18, 19. The connector shell 16 generally comprises a one-piece member preferably comprised of metal, such as stamped sheet metal, cast metal, or extruded and formed metal. In an alternate embodiment, the shell 16 could be comprised of more than one member. The shell 16 generally comprises a first section 20, a second section 22, and a middle section 24. The first and second sections 20, 22 form wedge receiving areas for receiving the respective wedges 18, 19. The middle section 24 functions as a structural bridge between the first and second sections 20, 22. In the embodiment shown, the middle section 24 comprises a window 26. However, the window 26 might not be provided. The opposite side of the shell forms a generally elongate open lateral side. The shell could have any suitable length, such as 10 inches for example. The shell could be extruded with a general C shape, and then formed into the shape shown.

The first and second sections 20, 22 are generally mirror images of each other. However, in alternate embodiments, the first and second sections could be different from each other. The first and second sections 20, 22 comprise a general wedge shaped profile and a general cross sectional C shape. In this embodiment, the first and second sections 20, 22 taper towards the middle section 24. The top sides of the first and second sections 20, 22 are substantially aligned with each other along a straight line. Each of the first and second sections 20, 22 comprise a conductor contact surface 28 and opposing wedge contact surfaces 30. The conductor contact surfaces 28 are located on the interior curved sides of the top sides of the first and second sections. Thus, the conductor contact surfaces 28 are substantially aligned with each other.

The two wedges 18, 19 are substantially mirror images of each other. However, in alternate embodiments, the two wedges 18, 19 could be different from each other. Each wedge 18, 19 preferably comprises a one-piece member made of a suitable material, such as cast or extruded metal, for example. In an alternate embodiment, each wedge could be comprised of more than one member. Each wedge 18, 19 comprises a first side with a conductor contact surface 32 and an opposite second side with a shell contact surface 34. Each wedge 18, 19 has a general wedge shaped profile between the surfaces 32, 34 from a front end 36 to a rear end 38. The shell contact surface on each wedge has a general curved projection profile, and the conductor contact surface on each wedge has a general groove shape.

Figure 14:
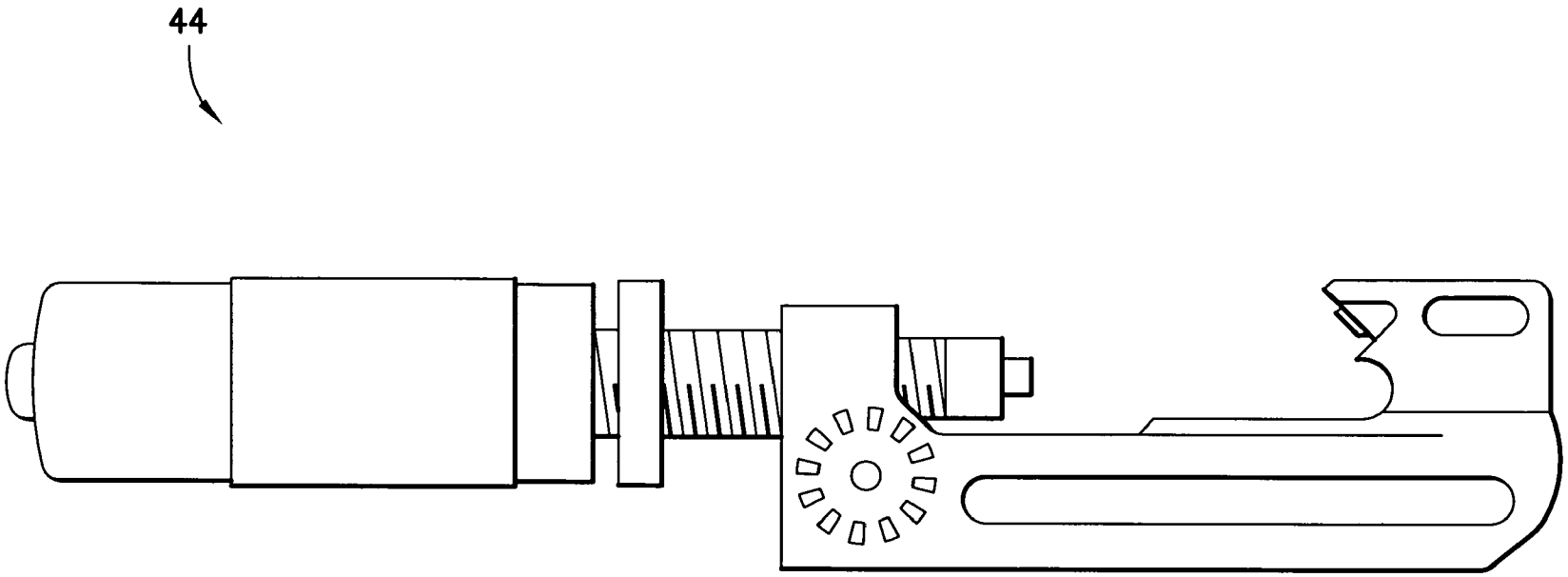
FIG. 14 PRIOR ART
FIG. 14 is a side view of a prior art installation tool.
Figure 15:
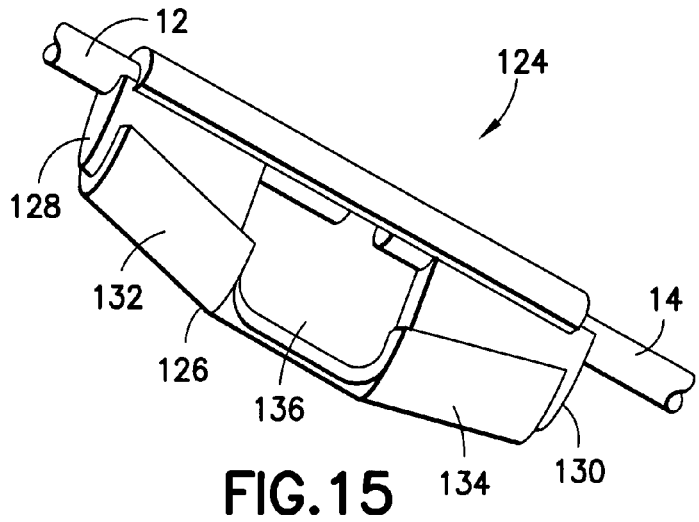
FIG. 15 is a perspective view of another alternate embodiment of the present invention.
Figure 16:
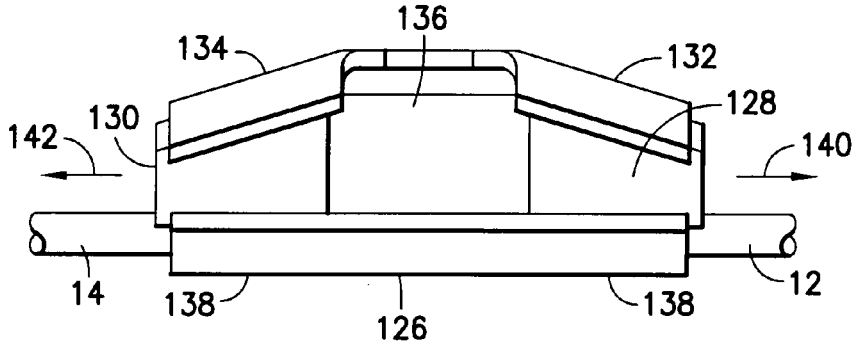
FIG. 16 is a side view of the splice connector shown in FIG. 15.
Figure 17:
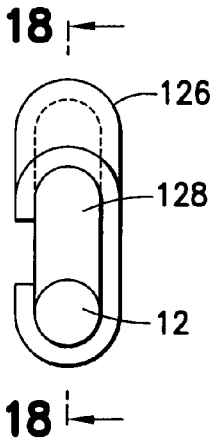
FIG. 17 is an end view of the splice connector shown in FIGS. 15–16.
Figure 18:
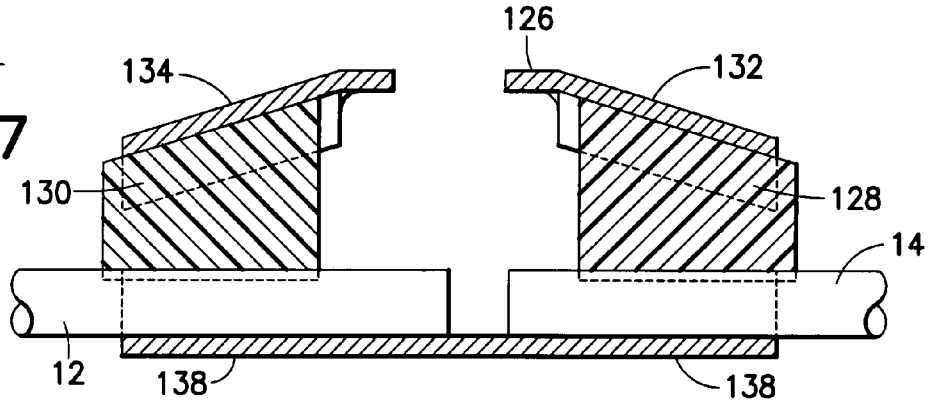
FIG. 18 is a cross sectional view of the splice connector shown in FIG. 17 taken along line 18—18.

To attach the splice 10 to the conductors 12, 14, the first conductor 12 is inserted into the first section 20 adjacent the conductor contact surface 28 in the first section and the first wedge 18 is inserted into the first section 20 as indicated by arrow 40. The first wedge 18 is preferably power wedged into the first section 20 by a suitable tool, such as the tool 44 shown in FIG. 14. However, in alternate embodiments, any suitable tool could be used to wedge the first wedge 18 into the shell 16. One such tool is described in U.S. Pat. No. 4,722,189 which is hereby incorporated by reference in its entirety. However, any suitable type of tool for wedging a wedge into a shell could be used. The tool 44 can use an end of the window 26 as a gripping surface for the front end of the tool. When the first wedge 18 is wedged into the shell 16 by the tool 44, the first conductor 12 is fixedly captured between the two conductor contact surfaces 28, 32.

The second conductor 14 is inserted into the second section 22 adjacent the conductor contact surface 28 in the second section and the second wedge 19 is inserted into the second section 22 as indicated by arrow 42. The second wedge 19 is preferably power wedged into the second section 22 by a suitable tool, such as the tool 44 shown in FIG. 14. When the second wedge 19 is wedged into the shell 16 by the tool 44, the second conductor 14 is fixedly captured between the two conductor contact surfaces 28, 32. The direction 40 of insertion of the first wedge 18 is reverse to the direction 42 of insertion of the wedge 19. In this embodiment, the two directions 40, 42 are towards each other. However, in an alternate embodiment, the two directions could be away from each other. The two conductors 12, 14 are, thus, fixedly connected by the splice 10 in a general aligned or coaxial position. The splice 10 provides both a mechanical and a electrical connection between the two conductors 12, 14. If proved reliable, this design could satisfy an "ease of installation" requirement and be highly marketable if reasonably priced.

Figure 4:
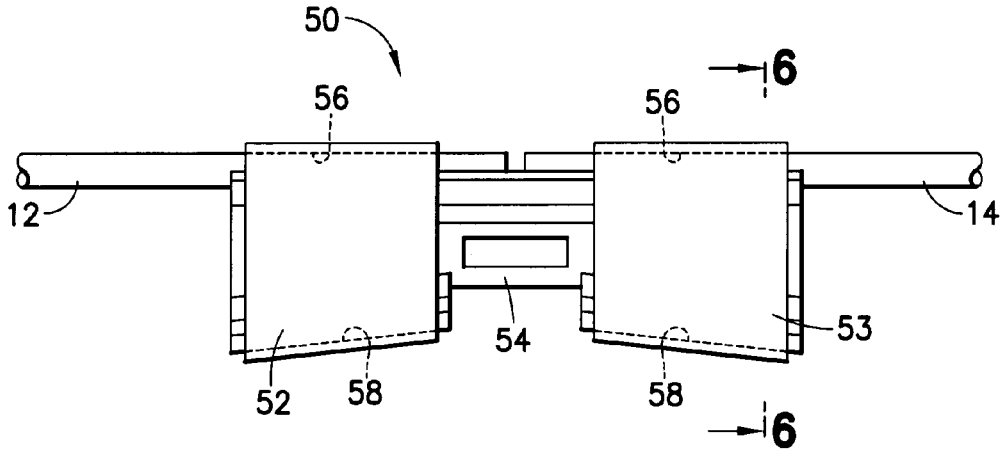
FIG. 4 is a side view of an alternate embodiment of a splice connector incorporating features of the present invention.
Figure 5:
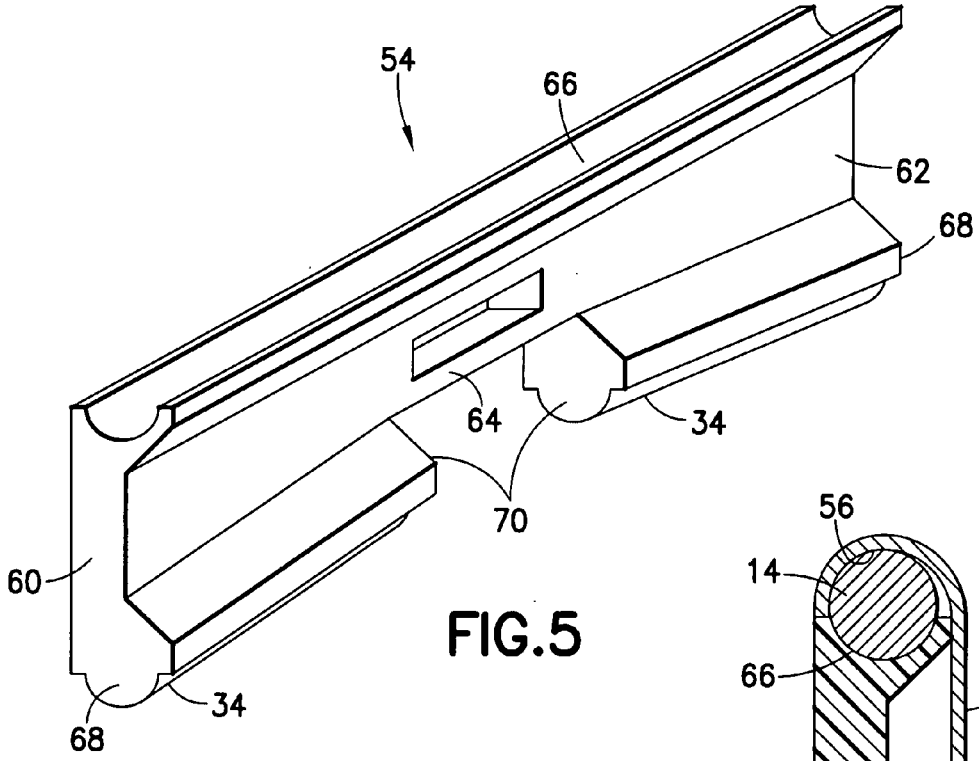
FIG. 5 is a perspective view of the wedge used in the splice connector shown in FIG. 4.
Figure 6:
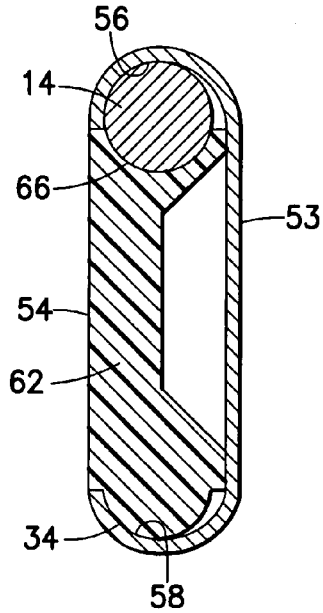
FIG. 6 is a cross sectional view of the splice connector shown in FIG. 4 taken along line 6—6.

Referring now also to FIGS. 4–6, one alternate embodiment of the present invention is shown. In this embodiment the splice connector 50 generally comprises two connector shells 52, 53 and a single wedge member 54. The two conductor shells 52, 53 are generally mirror images of each other. However, in alternate embodiments, the two conductor shells could be different from each other. Each shell 52, 53 comprises a general wedge shaped profile and a general cross sectional C shape. In this embodiment, the shells 52, 53 are attached to the wedge member 54 such that the shells 52, 53 taper towards a middle of the splice connector 50. The top sides of the shells 52, 53 are substantially aligned with each other along a straight line. Each of the shells 52, 53 comprise a conductor contact surface 56 and an opposing wedge contact surface 58. The conductor contact surfaces 56 are located on the interior curved sides of the top sides of the shells. Thus, the conductor contact surfaces 56 are substantially aligned with each other.

In this embodiment the wedge member 54 is a one-piece member made of a suitable material such as metal. The wedge member 54 comprises two end sections 60, 62 which are connected by a middle section 64. The two end sections 60, 62 are substantially mirror images of each other. However, in alternate embodiments, the two end sections 60, 62 could be different from each other. A first side of the wedge member 54 has a conductor contact surface 66 which extends along the length of the sections 60, 62, 64. Each end section 60, 62 comprises an opposite second side with a shell contact surface 34. Each end section 60, 62 has a general wedge shaped profile between the surfaces 66, 34 from an outer end 68 to an inner end 70. The two end sections 60, 62 are tapered as they extend towards the middle section 64.

To attach the splice 50 to the conductors 12, 14, the first conductor 12 is located on the conductor contact surface 66 at the first end section 60 and the first shell 52 is inserted onto the first end section 60. The wedge member 54 is preferably power wedged into the first shell 52 by a suitable tool, such as the tool 44 shown in FIG. 14. However, in alternate embodiments, any suitable tool could be used. The tool 44 can use the inner end of the shell as a gripping surface for the front end of the tool. When the first shell 2 is wedged with the first end section of the wedge member by the tool 44, the first conductor 12 is fixedly captured between the two conductor contact surfaces 56, 66.

The second conductor 14 is inserted onto the conductor contact surface 66 at the second end section 62 and the second shell 53 is inserted onto the second end section 62. The second shell 53 is preferably power wedged onto the second end section 62 by a suitable tool, such as the tool 44 shown in FIG. 14. When the second shell 53 is wedged onto the second wedge section 62 by the tool 44, the second conductor 14 is fixedly captured between the two conductor contact surfaces 66, 56. The direction of mounting of the first shell 52 is reverse to the direction of mounting of the second shell 53. In this embodiment, the two directions are away from each other. However, in an alternate embodiment, the two directions could be towards each other. The two conductors 12, 14 are, thus, fixedly connected by the splice 50 in a general aligned or coaxial position. The splice 50 provides both a mechanical and an electrical connection between the two conductors 12, 14.

This design holds slightly more promise as wedge extraction would not be a problem. In addition, costs would be lessoned as only one new component (an integrated wedge) need be designed/produced. As with the integrated shell design of FIG. 1, performance is dependent upon the C-members being able to generate enough clamping force to mechanically hold the conductor during full-tension applications. Development costs could be reduced through utilization of available conventional C-members. Installation would not be significantly more complicated than installing two tap connections. If demonstrated to be reliable and reasonably priced, this design would prove highly marketable.

Figure 7:
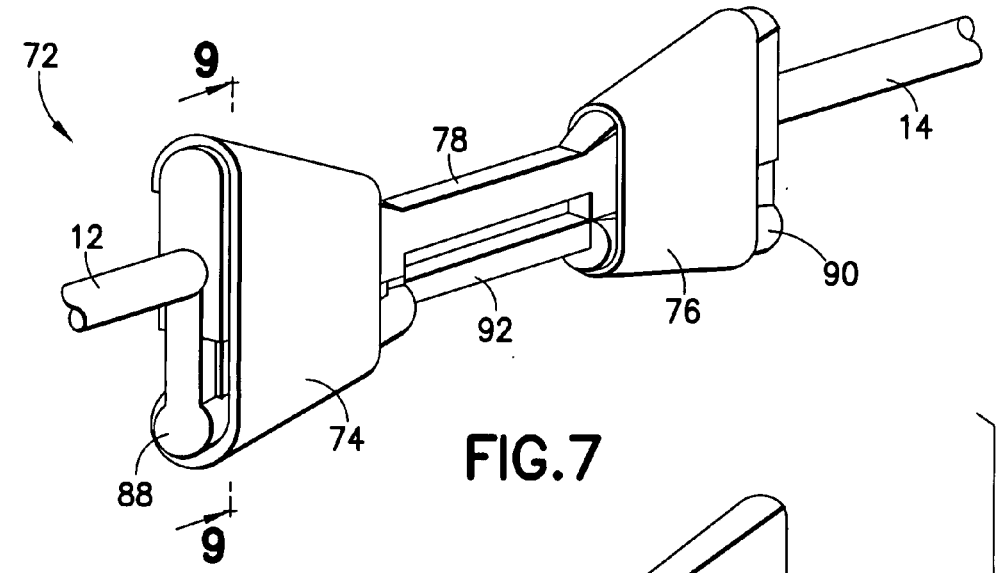
FIG. 7 is a perspective view of an alternate embodiment of the splice connector.
Figure 8:
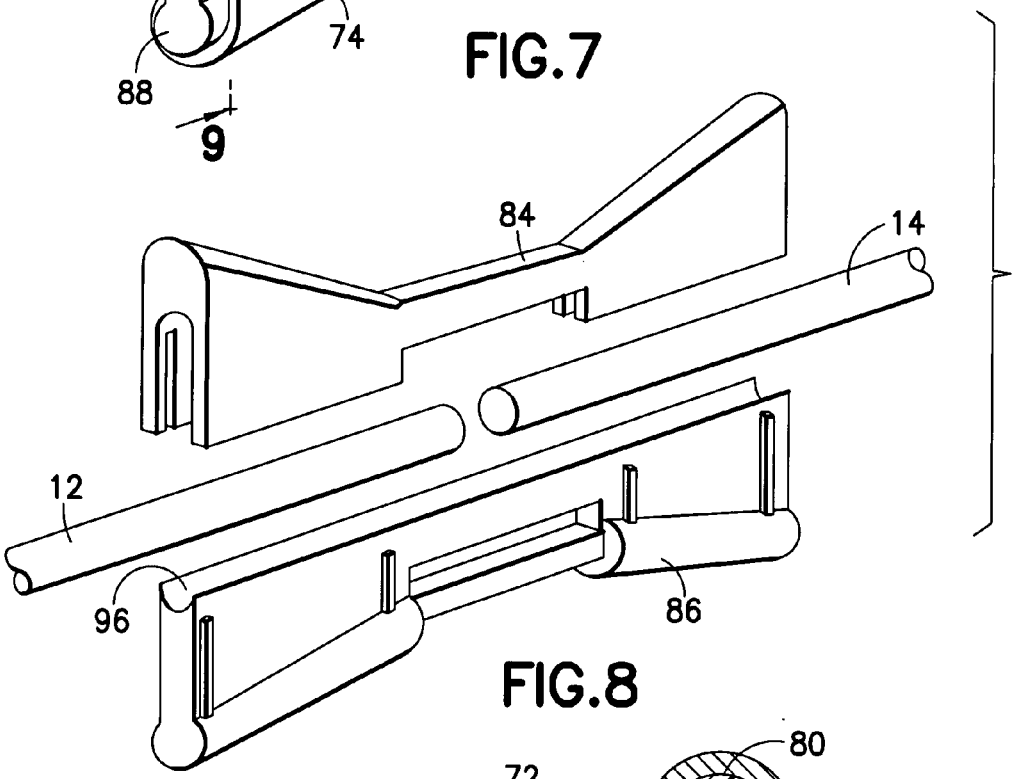
FIG. 8 is an exploded perspective view of the splice connector shown in FIG. 7 without showing the shells.
Figure 9:
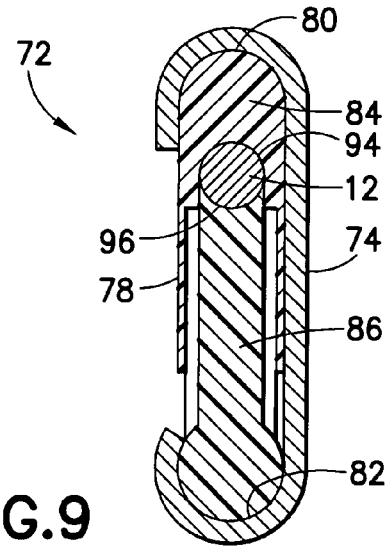
FIG. 9 is a cross sectional view of the splice connector shown in FIG. 7 taken along line 9—9.

Referring now also to FIGS. 7–9, another alternate embodiment of the present invention is shown. In this embodiment the splice connector 72 generally comprises two connector shells 74, 76 and a wedge member 78. The two conductor shells 74, 76 are generally mirror images of each other. However, in alternate embodiments, the two conductor shells could be different from each other. Each shell 74, 76 comprises a general wedge shaped profile and a general cross sectional C shape. In this embodiment, the shells 74, 76 are attached to the wedge member 78 such that the shells 74, 76 taper towards a middle of the splice connector 72. Each of the shells 74, 76 comprise two opposing wedge contact surfaces 80, 82. The wedge contact surfaces 80, 82 are located on the interior curved sides of the top and bottom sides of the shells.

In this embodiment the wedge member 78 is a multi-piece member made of a suitable material such as metal. The wedge member 78 comprises a top member 84 and a bottom member 86. When the top and bottom members 84, 86 are assembled, the wedge member 78 comprises two end sections 88, 90 which are connected by a middle section 92. The top and bottom wedge members 84, 86 are adapted to be slidably connected to each other in a general telescoping orientation as seen best in FIG. 9. The top of the bottom member 86 slides into a receiving area in the bottom of the top member 84. This captures the two conductors 12, 14 between opposing inner conductor contact surfaces 94, 96 of the two members 84, 86.

To attach the splice 72 to the conductors 12, 14, the conductors 12, 14 are placed between the top and bottom members 84, 86. The top and bottom members 84, 86 are connected to each other to sandwich the conductors 12, 14 between the surfaces 94, 96. The shells 74, 76 are then mounted on the wedge shaped end sections 88, 90 and wedged into a final clamping position by a suitable tool. The shells 74, 76, thus, keep the top and bottom members 84, 86 clamped together to keep the conductors 12, 14 clamped inside the wedge shaped end sections 88, 90.

Figure 13:
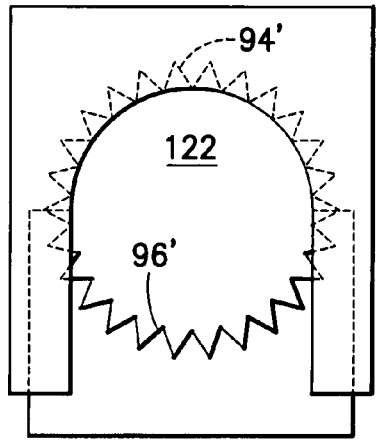
FIG. 13 is an end view showing an alternate embodiment of the present invention.

This design addresses both the issue of wedge extraction and conductor "pull out". Although it would require development and production of an entirely new wedge design, it could utilize existent C-member components to provide required clamping forces. What is unique about this design is that the C-members would not be in direct contact with the conductors. As such, the shell's rather smooth surface would not be relied upon to mechanically hold the conductor during full-tension applications. In this proposed "integrated split wedge" design, the conductor would be captured between two inter-locking components in a scissoring or more accurately, a "guillotine clamping" effect. In this design, the C-members provide required clamping forces while contributing minimally to electrical connectivity. Also, the length (such as 10 inches for example) and ribbed contact surfaces of the split wedge would enhance conductor gripping. Electrical contact, wedge integrity, "guillotine" clamping effect and uniformity of motion during the installation process would be achieved via the interlocking "tongue & groove" design of the integrated split wedge. It is expected the proposed "integrated split wedge" would afford superior electrical performance and above-average mechanical integrity. Wedge assembly is inline with conductor run enhancing clamping forces and eliminating transverse stress concerns. A slight outer flange on the end of wedge assembly, conforming to original conductor diameter as shown in FIG. 13, can enhance the "guillotine clamping" action and significantly inhibits extraction of distorted or expanded conductor following installation.

In this design, conductor "pull-out" is the primary concern. This might be mitigated by "ribbing" all conductor contact surfaces (in-line with stranding) in the manner illustrated in FIG. 13. Insertion rate and resultant wiping action may be mildly diminished, but conductor "pull out" resistance should be enhanced substantially. The "ribs" can insert themselves between strands, deforming and expanding the conductor diameter. If entrance/exit holes were made to original conductor outer diameter (OD), it would seem difficult for deformed/expanded conductor ends to exit the installed connector.

Because C-members are "floating", only providing required clamping forces and not directly responsible for holding/gripping the conductor, potential for wedge extraction and conductor "pull-out" should be lessoned. This design should prove capable of being utilized as a full-tension device.

While it seems this proposed design might diminish the wiping action typically associated with fired-on wedge installations, the conductor piercing action might actually serve to disperse oxide inhibitor, create more "A" spots, enhance electrical conductivity and reduce resistance. The "guillotine" configuration of the integrated split wedge should allow for expansion/contraction of conductor in response to amperage or ambient temperature changes.

Figure 10:
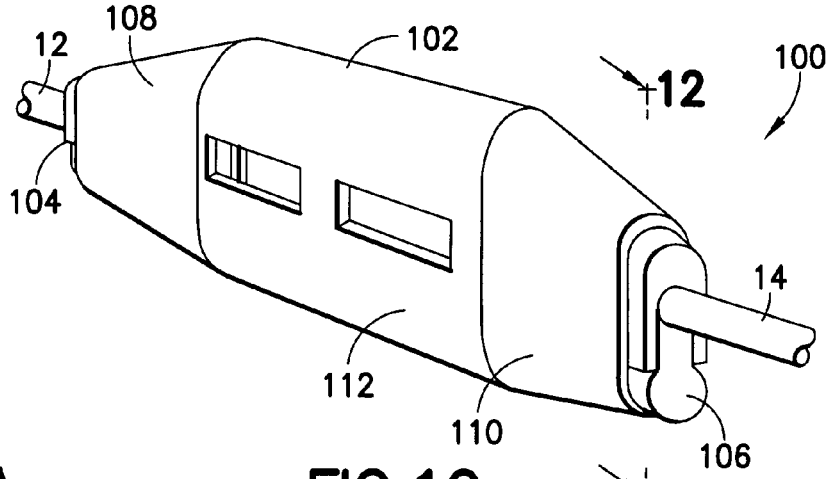
FIG. 10 is a perspective view of an alternate embodiment of the splice connector.
Figure 11:
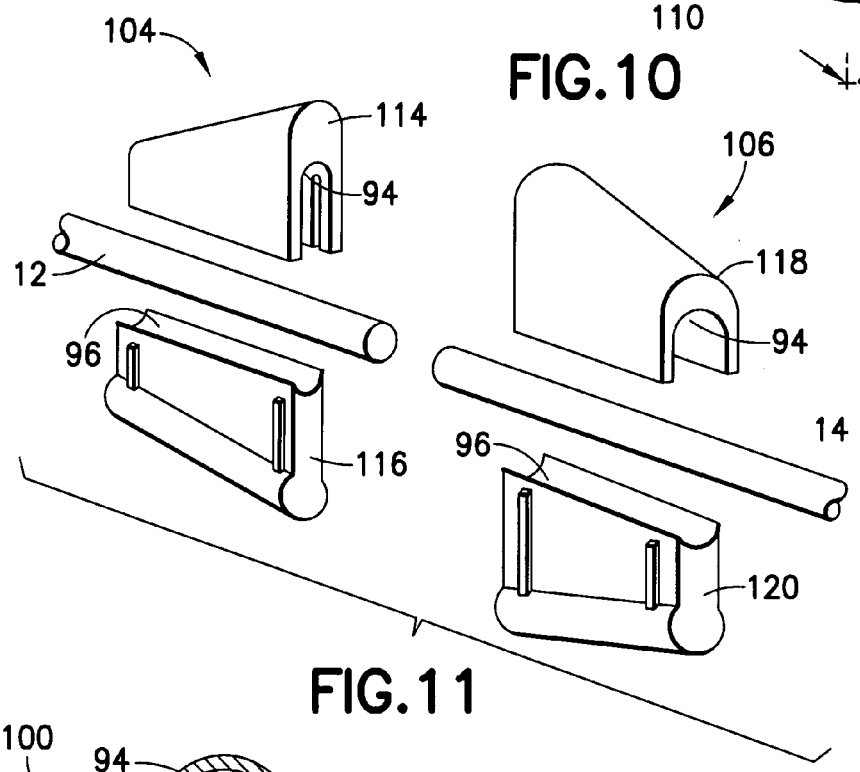
FIG. 11 is an exploded perspective view of the splice connector shown in FIG. 10 without showing the shell.
Figure 12:
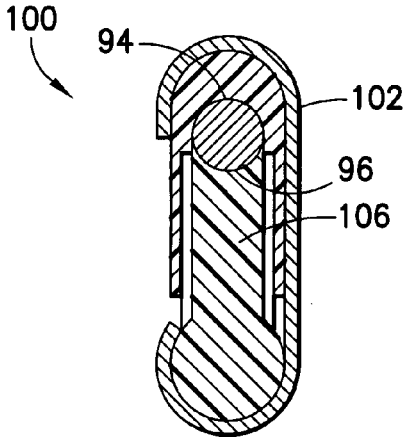
FIG. 12 is a cross sectional view of the splice connector shown in FIG. 10 taken along line 12—12.

Referring now also to FIGS. 10–12, another alternate embodiment of the present invention is shown. In this embodiment the splice 100 comprises a single shell 102 and two wedges 104, 106. The shell 102 comprises a one-piece member made of a suitable material, such as metal. The shell 102 comprises two wedge shaped end sections 108, 110 and a middle section 112. The two wedge shaped sections 108, 110 are tapered in outward directions. The wedges 104, 106 each comprise two wedge members 114, 115 and 116, 117, respectively. The wedge members in each pair 114, 115 and 116, 117 are adapted to be slidably connected to each other in a general telescoping orientation as seen best in FIG. 12. The bottom members 116, 120 slide into receiving areas in the top members 114, 118. This captures the two conductors 12, 14 between opposing inner conductor contact surfaces 94, 96 of the opposing top and bottom members. The pairs of wedge members 114, 116 and 118, 120 are subsequently wedged into the wedge shaped end sections 108, 110 by a suitable tool in opposite directions (outward) to fixedly clamp the wedges and conductors inside the end sections.

The proposed splice, as exemplified by this embodiment, might function better if the wedges are pointed away from the conductor ends. One might originally think, based upon prior art fired-on connectors, that designing a fired-on connector for an in-line splice was impossible because the tool would have no room to be positioned directly behind the wide part of the wedge. New users of prior art fired-on connectors are taught that, during installation, the wedge is driven into the C-body and during "take-off" the C-body is driven off the wedge. With the present invention, this process is reversed and uses the "take-off" clips to drive a C-body onto the wedge during installation. In this way, a wedge could be installed in the proposed "integrated shell" facing away from the conductor ends.

A two-piece "guillotine" inter-locking wedge assembly could be provided such as shown in FIG. 13. In this configuration, the lateral force exerted by a full-tension application could serve to enhance the mechanical/electrical contact created by the connector. In essence, the more tension exerted, the tighter the connection made. There should be no "bird-caging" effect because the C-body is not in contact with the conductor. This design might allow one to angle or "serrate" the ribs back toward the bitter end of the conductor. In this way, any extraction forces would meet with additional resistance.

Assuming a C-member is created that is narrowed at each end, this design will function extremely well in a full-tension application. It is quite possible "drawing" of tension might accomplish wedge insertion (and desired connection) without use of an installation tooling. If so, this design could be described as a "fully-automatic" splice. If installed with WEJTAP™ tooling and "take-off" clips, a "skive" could be created in the rear side of the lower wedge component. This skive could serve to "lock" the components together creating a more homogeneous assembly and reliable connection.

Referring now to FIG. 13, one adaptation of the conductor contact surfaces 94', 96' is shown. As seen in this figure, the surfaces 94', 96' comprise ridges and grooves to form opposing teeth in a conductor receiving area 122. This illustrates that the opposing surfaces of the mating pair of wedge members, such as seen in FIGS. 9 and 12, can have any suitably shaped surface to help grip onto the conductors 12, 14 captured between the surfaces.

Referring now to FIGS. 15–18, another alternate embodiment of the present invention is shown. The splice connector 124 generally comprises a one-piece shell 126 and two wedges 128, 130. The shell 126 comprises a one-piece member such as comprised of metal. The shell 126 has two wedge shaped end sections 132, 134 and a connecting middle section 136. Similar to the embodiment shown in FIG. 1, the wedge shaped end sections 132, 134 have sides 138 which are aligned with a side of the middle section to allow the conductors 12, 14 to be aligned when connected with the splice connector. However, in this embodiment, the wedge shaped end sections 132, 134 are tapered in outward directions.

To attach the splice 124 to the conductors 12, 14, the first conductor 12 is inserted into the first end section 132 adjacent the conductor contact surface in the first end section and the first wedge 128 is inserted into the first end section 132 as indicated by arrow 140. The first wedge 128 is preferably power wedged into the first end section 132 by a suitable tool, such as the tool 44 shown in FIG. 14. When the first wedge 128 is wedged into the shell 126 by the tool 44, the first conductor 12 is fixedly captured between the two conductor contact surfaces of the wedge and the shell.

The second conductor 14 is inserted into the second end section 134 adjacent the conductor contact surface in the second end section and the second wedge 130 is inserted into the second end section 134 as indicated by arrow 142. The second wedge 130 is preferably power wedged into the second end section 134 by a suitable tool, such as the tool 44 shown in FIG. 14. When the second wedge 134 is wedged into the shell 126 by the tool 44, the second conductor 14 is fixedly captured between the two opposing conductor contact surfaces on the wedge 130 and second end section 134. The direction 140 of insertion of the first wedge 128 is reverse to the direction 142 of insertion of the second wedge 130. In this embodiment, the two directions 140, 142 are away from each other. The two conductors 12, 14 are thus fixedly connected by the splice 124 in a general aligned or coaxial position. The splice 124 provides both a mechanical and a electrical connection between the two conductors 12, 14.

Figure 19:
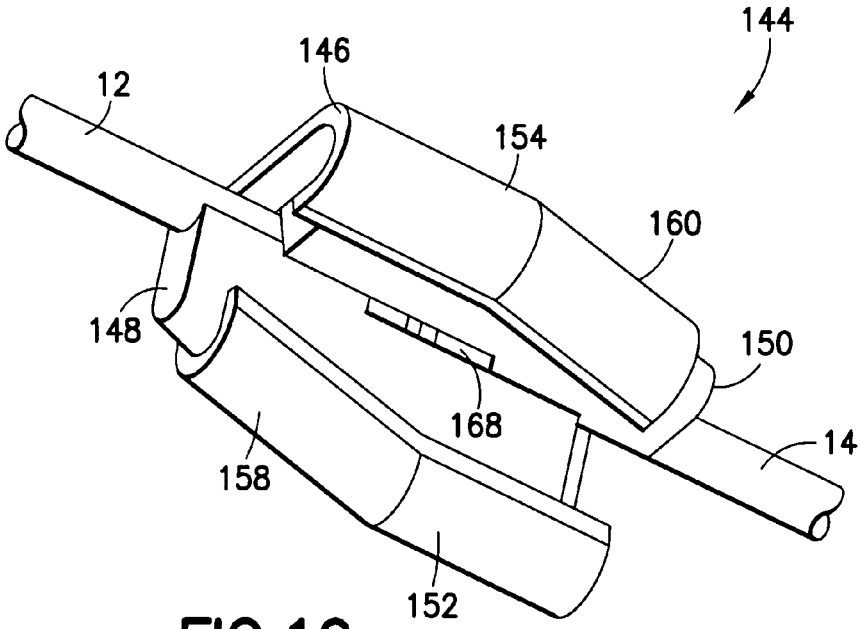
FIG. 19 is a perspective view of another alternate embodiment of the present invention.
Figure 20:
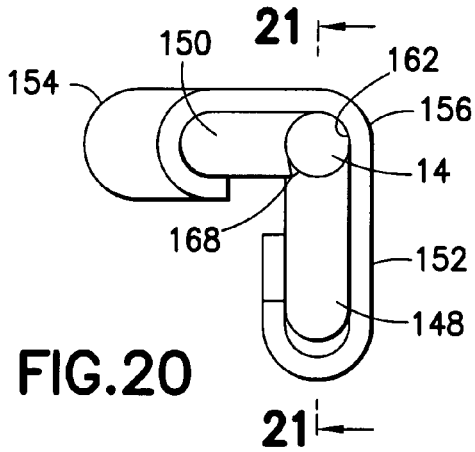
FIG. 20 is an end view of the splice connector shown in FIG. 19.
Figure 21:
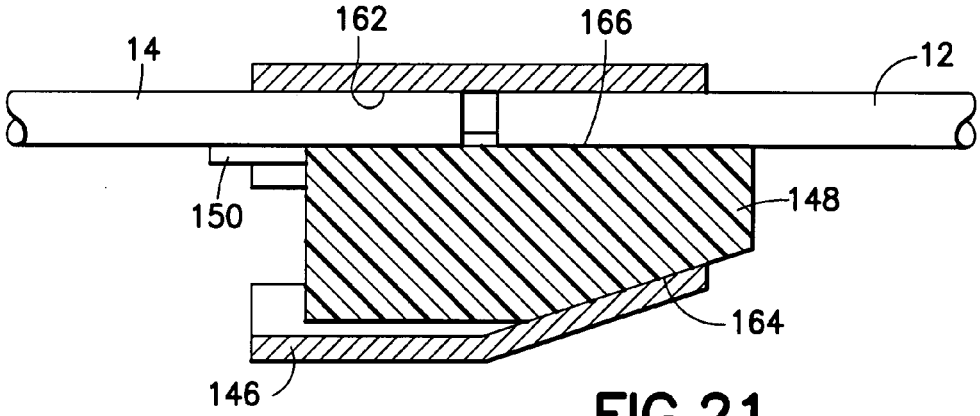
FIG. 21 is a cross sectional view of the splice connector shown in FIG. 20 taken along line 21—21.

Referring now to FIGS. 19–21, another alternate embodiment of the present invention is shown. In this embodiment the splice connector 144 comprises a shell 146 and two wedges 148, 150. The shell 146 is preferably comprised of a one-piece metal member. The shell 146 comprises a first wedge receiving section 152, a second wedge receiving section 154, and a connecting section 156. The first and second wedge receiving sections 152, 154 each have a general J shaped cross section and are angled relative to each other. In this embodiment the angle is about 90 degrees. However, in alternate embodiments, any suitable angle could be provided.

The first wedge receiving section 152 comprises a wedge shaped section 158 which tapers towards a first end of the shell. The second wedge receiving section 154 comprises a wedge shaped section 160 which tapers towards a second opposite end of the shell. The connecting section 156 has an inner surface 162 which forms a curved conductor contact surface for the conductors 12, 14 to be clamped against.

The wedges 148, 150 are substantially the same, but merely orientated in reverse orientations and angled 90 degrees relative to each other. The wedges 148, 150 each comprise a wedge shaped section with a shell contacting surface 164 and an opposite conductor contacting surface 166. Each wedge 148, 150 also comprises a wedge slot 168 to accommodate movement of a portion of the other wedge therein.

To attach the splice 144 to the conductors 12, 14, the first and second conductors 12, 14 are inserted into the shell 146 through opposite ends of the shell and are located adjacent the conductor contact surface 162 in the connecting section 156. The first wedge 148 is inserted into the first wedge shaped section 158. The first wedge 148 is preferably power wedged into the first wedge shaped section 158 by a suitable tool, such as the tool 44 shown in FIG. 14. When the first wedge 148 is wedged into the shell 146 by the tool 44, the first conductor 12 is fixedly captured between the two conductor contact surfaces 162, 166 of the first wedge and the shell. The second wedge 150 is inserted into the second wedge shaped section 160. The second wedge 150 is preferably power wedged into the second wedge shaped section 160 by a suitable tool, such as the tool 44 shown in FIG. 14. When the second wedge 150 is wedged into the shell 146 by the tool 44, the second conductor 14 is fixedly captured between the two conductor contact surfaces 162, 166 of the second wedge and the shell. Because the conductors 12, 14 are located against the same shell inner surface 162, they are aligned relative to each other. The angled shell can allow the splice connector to be located in a uniquely shaped area and form a more compact design.

Referring now to FIGS. 22–24, another alternate embodiment of the present invention is shown. In this embodiment the splice connector 170 comprises a shell 172 and two wedges 174, 176. The shell 172 is preferably comprised of a one-piece metal member, such as multiple member which are permanently connected to each other. The shell 172 comprises a first wedge receiving section 178 and a second wedge receiving section 180. The shell 172 comprises a top side and a bottom side with curved walls forming inner wedge contacting surfaces 182, 184. The shell 172 also comprises two interior projections 186, 188. The projections 186, 188 have curved shapes and form conductor contact surfaces 190, 192. The projections 186, 188 are respectively located opposite the wedge contacting surfaces 182, 184 to form the wedge receiving sections 178, 180. The projections 186, 188 are angled relative to their respective opposing wedge contacting surfaces 182, 184 to form the wedge shapes of the wedge receiving sections.

To attach the splice 170 to the conductors 12, 14, the first conductor 12 is inserted into the first end of the shell 172 adjacent the conductor contact surface 190 and the first wedge 174 is inserted into the first wedge receiving area 178. The first wedge 174 is preferably power wedged into the first wedge receiving area 178 by a suitable tool, such as the tool 44 shown in FIG. 14. When the first wedge 174 is wedged into the shell 172 by the tool 44, the first conductor 12 is fixedly captured between the two conductor contact surfaces 190, 194 of the first wedge and the shell.

The second conductor 14 is inserted into the second wedge receiving area 180 adjacent the conductor contact surface 192 in the second wedge receiving area 180 and the second wedge 176 is inserted into the second wedge receiving area. The second wedge 176 is preferably power wedged into the second wedge receiving area 180 by a suitable tool, such as the tool 44 shown in FIG. 14. When the second wedge 176 is wedged into the shell 172 by the tool 44, the second conductor 14 is fixedly captured between the two opposing conductor contact surfaces 192, 194 on the second wedge 176 and shell. The direction of wedging insertion of the first wedge 174 is reverse to the direction of insertion of the second wedge 176. In this embodiment, the two directions are away from each other. The wedges are at least partially offset or misaligned from each other to allow access to the rear ends of the wedges by the installation tool. The two conductors 12, 14 are, thus, fixedly connected by the splice 170 in a general aligned or coaxial position, but can exit the ends of the shell at an angle. The splice 170 provides both a mechanical and an electrical connection between the two conductors 12, 14.

The present invention can utilize fired-on wedge technology to create a highly reliable full tension splice which is quick and easy to install while remaining cost-effective. In a preferred embodiment, the wider ends of the opposing wedges are positioned inward (towards the cable break) in a manner which lateral forces might actually serve to enhance wedge insertion and the resultant mechanical/electrical and integrity.

It is assumed the reason this product has not already been created lies in an inherent inability of conventional fired-on wedge connectors to withstand "pull-out' forces generated in full-tension applications. Specifically, either the C-member is incapable of producing sufficient clamping forces to maintain mechanical hold of conductor under lateral stress, or the wedge is extracted as a result of the same forces.

The remedy, whereby the wider ends of opposing wedges are positioned inward (toward the cable break) in a manner which lateral forces might actually serve to enhance wedge insertion and resultant mechanical/electrical integrity, is rendered impossible in a conventional fired-on connector design due to the requirement to position the tool directly behind the wedge during installation. Also, introducing the wedge against the conductor stranding direction would undoubtedly create a "bird caging" problem. As such, attention was focused solely upon configurations in which the wider ends of opposing wedges were positioned outward away from the cable break. However, these problems can be overcome and the present invention can be used.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical conductor splice for connecting at least two electrical conductors, the splice comprising:

a connector shell comprising a generally elongate open first lateral side; and two wedges adapted to be located in the shell at longitudinally spaced positions from each other inside opposite ends of the shell, each wedge having a first side with a conductor contact surface and an opposite second side with a shell contact surface, wherein the shell comprises a conductor contact section for contacting the conductors, the conductor contact section being adapted to receive two of the conductors into the shell from opposite directions in generally coaxially aligned positions, wherein the connector shell comprises two opposite ends which comprise general wedge shaped profiles orientated in general reverse directions relative to each other, wherein the connector shell comprises a middle section between the general wedge shaped profiles, and wherein the two opposite ends taper towards the middle section.

2. An electrical conductor splice as in claim 1 wherein the connector shell comprises a second opposite lateral side having at least one aperture therethrough.

3. An electrical conductor splice as in claim 1 wherein the connector shell comprises a general cross sectional C shape.

4. An electrical conductor splice as in claim 3 wherein the conductor contact section comprises a generally straight channel on a top side of the general cross sectional C shape.

5. An electrical conductor splice for connecting at least two electrical conductors, the splice comprising:

a connector shell comprising a generally elongate open first lateral side; and two wedges adapted to be located in the shell at longitudinally spaced positions from each other inside opposite ends of the shell, each wedge having a first side with a conductor contact surface and an opposite second side with a shell contact surface, wherein the shell comprises a conductor contact section for contacting the conductors, the conductor contact section being adapted to receive two of the conductors into the shell from opposite directions in generally coaxially aligned positions, wherein the conductor contact surface on each wedge is angled relative to the shell contact surface on the wedge.

6. An electrical conductor splice as in claim 5 wherein the shell contact surface on each wedge has a general curved projection profile, and the conductor contact surface on each wedge has a general groove shape.

7. An electrical conductor splice connector shell comprising:

a first wedge receiving end section having a general wedge shaped profile; and a second wedge receiving end section having a general wedge shaped profile, the first and second end sections being located at opposite longitudinal ends of the shell and having their wedge shaped profiles orientated in general reverse directions, wherein the shell comprises a general cross sectional C shape, wherein the first and second wedge receiving end sections comprise a common longitudinal wall of the shell with opposite ends of the common longitudinal wall forming two conductor contact surfaces at respective ones of the wedge receiving end sections for directly contacting conductors, and wherein each wedge receiving end section comprises tapered portion opposite respective ones of the two conductor contact surfaces for directly contacting wedges inserted into the first and second wedge receiving end sections.

8. An electrical conductor splice connector shell as in claim 7 wherein the wedge shaped profiles of the first and second end sections taper in outward directions.

9. An electrical conductor splice connector shell as in claim 7 wherein the wedge shaped profiles of the first and second end sections taper in an inward direction.

10. An electrical conductor splice connector shell as in claim 7 wherein a first lateral wall of the shell is generally open and an opposite second lateral wall of the shell comprises at least one aperture therein which is located between the first and second end sections.

11. An electrical conductor splice connector shell as in claim 7 wherein a top side of the shell has a substantially straight profile.

12. An electrical conductor splice for connecting at least two electrical conductors, the splice comprising:

an electrical conductor splice connector shell as in claim 7; and two wedges adapted to be located in the shell at longitudinally spaced positions from each other inside opposite ends of the shell.

13. An electrical conductor splice as in claim 12 wherein at least one of the wedges comprises two wedge pieces slidably connected to each other and having a conductor receiving area located between the two wedge pieces, wherein a first one of the two wedge pieces comprises a general U-shaped profile and a second one of the wedge pieces slidably extends between legs of the general U-shaped profile.

14. An electrical wedge connector splice wedge comprising:

a first end section having a general wedge shaped profile with a first conductor contact surface on a first side of the wedge; and a second end section having a general wedge shaped profile with a second conductor contact surface on the first side of the wedge, wherein the first and second end sections are located at opposite longitudinal ends of the wedge, and wherein their wedge shaped profiles are orientated in general reverse directions.

15. An electrical wedge connector splice wedge as in claim 14 wherein the wedge further comprises a middle section located between the first and second end sections, the middle section comprising an aperture therethrough.

16. An electrical wedge connector splice wedge as in claim 14 wherein the first side of the wedge comprises a groove therealong which forms the first and second conductor contact surfaces.

17. An electrical wedge connector splice wedge as in claim 14 wherein the wedge shaped profiles of the first and second end sections taper inward towards each other.

18. An electrical conductor splice for connecting at least two electrical conductors, the splice comprising:

an electrical wedge connector splice wedge as in claim 14; and two electrical wedge connector shells adapted to be respectively connected to the first and second end sections of the splice wedge with the two electrical conductors to thereby wedge the two electrical conductors between the shells and the splice wedge.

19. An electrical wedge connector splice wedge comprising:

a first member having a first side and a second opposite side, the first side comprising a first electrical wedge connector splice shell contact surface, the second opposite side comprising a slot extending into the second opposite side, the slot having a first conductor contact surface therein; and a second member movably connected to the first member, the second member extending into the slot, wherein the second member comprises a first side and an opposite second side, the first side of the second member comprising a second electrical wedge connector splice shell contact surface located in the slot, and the second opposite side of the second member comprising a second conductor contact surface, wherein the first and second conductor contact surfaces are located opposing each other.

20. An electrical wedge connector splice wedge as in claim 19 wherein the first and second members are slidably connected to each other.

21. An electrical wedge connector splice wedge as in claim 19 wherein the first member has a general cross sectional U shape.

22. An electrical wedge connector splice wedge as in claim 19 wherein the first and second members form an aperture through a middle section of the splice wedge.

23. An electrical wedge connector splice wedge as in claim 19 wherein the first and second members form a first wedge shaped end and a spaced opposite second wedge shaped end.

24. An electrical wedge connector splice wedge as in claim 19 wherein the first and second wedge shaped ends are tapered towards a middle section of the splice wedge.

25. An electrical conductor splice for connecting at least two electrical conductors, the splice comprising:

an electrical wedge connector splice wedge as in claim 19; and two electrical wedge connector shells adapted to be respectively connected to opposite first and second end sections of the splice wedge with the two electrical conductors located between the first and second members to thereby wedge the splice wedge into the two shells to fixedly clamp the two electrical conductors between the first and second members of the splice wedge.

26. An electrical conductor splice for connecting at least two electrical conductors, the splice comprising:

a connector shell comprising a generally elongate open first lateral side; and two wedges adapted to be located in the shell at longitudinally spaced positions from each other inside opposite ends of the shell, each wedge having a first side with a conductor contact surface and an opposite second side with a shell contact surface, wherein the shell comprises a conductor contact section for contacting the conductors, the conductor contact section being adapted to receive two of the conductors into the shell from opposite directions in generally coaxially aligned positions directly against a surface of the conductor contact section.

27. An electrical conductor splice for connecting at least two electrical conductors, the splice comprising:

a connector shell; and two wedges adapted to be located in the shell at opposite ends of the shell, each wedge having a first side with a conductor contact surface and an opposite second side with a shell contact surface, wherein the shell comprises at least one conductor contact section for contacting the conductors, and wherein the at least one conductor contact section is adapted to receive two of the conductors in a generally aligned position at the respective opposite ends of the shell directly against a surface of the conductor contact section.

28. An electrical conductor splice as in claim 27 wherein the shell comprises a first wedge receiving area and a second wedge receiving area, and wherein the first wedge receiving area is laterally adjacent the second wedge receiving area.

29. An electrical conductor splice as in claim 27 wherein the shell comprises a first wedge receiving area and a second wedge receiving area, and wherein the first and second wedge receiving areas are partially intermixed with each other.

30. An electrical conductor splice as in claim 27 wherein the two wedges intermesh with each other.

31. An electrical conductor splice as in claim 27 wherein the at least one conductor contact section of the shell comprises two outward facing interior conductor receiving channels, and wherein the shell comprises two inward facing wedge contact surfaces opposite respective ones of the outward facing interior conductor receiving channels.

32. An electrical conductor splice as in claim 27 wherein the two opposite ends of the connector shell comprise general wedge shaped profiles.

33. An electrical conductor splice as in claim 32 wherein the general wedge shaped profiles of the two opposite ends are orientated in general reverse directions relative to each other.

34. An electrical conductor splice as in claim 33 wherein the two opposite ends taper in outward directions.

35. An electrical conductor splice for connecting at least two electrical conductors, the splice comprising:

a connector shell; and two wedges adapted to be located in the shell at opposite ends of the shell, each wedge having a first side with a conductor contact surface and an opposite second side with a shell contact surface, wherein the shell comprises at least one conductor contact section for contacting the conductors, and wherein the at least one conductor contact section is adapted to receive two of the conductors in a generally aligned position at the respective opposite ends of the shell, wherein the shell comprises a first wedge receiving area and a second wedge receiving area, and wherein the first wedge receiving area is laterally adjacent the second wedge receiving area, wherein the first wedge receiving area is angled relative to the second wedge receiving area.

* * * * *